United States Patent [19]

Bardsley et al.

[11] 4,445,447

[45] May 1, 1984

[54] TUFTING MACHINE APPARATUS

[75] Inventors: Harold B. Bardsley, Euxton, Near Chorley; Ian Beverley, Blackburn, both of England

[73] Assignee: Spencer Wright Industries, Inc., Chattanooga, Tenn.

[21] Appl. No.: 450,652

[22] Filed: Dec. 17, 1982

[30] Foreign Application Priority Data

Jan. 7, 1982 [GB] United Kingdom ..... 8200452

[51] Int. Cl.[3] ..... D05C 15/00

[52] U.S. Cl. ..... 112/79 R; 112/79 A

[58] Field of Search ..... 112/79 R, 79 FF, 79 A

[56] References Cited

U.S. PATENT DOCUMENTS

| | | | |
|---|---|---|---|
| 3,908,570 | 9/1975 | Puckett | 112/79 A |
| 3,964,408 | 6/1976 | Smith | 112/79 R |
| 3,972,295 | 8/1970 | Smith | 112/79 A |
| 4,010,700 | 3/1977 | Webb | 112/79 R |
| 4,173,192 | 11/1979 | Schmidt et al. | 112/79 R |

*Primary Examiner*—Ronald Feldbaum
*Attorney, Agent, or Firm*—Alan Ruderman

[57] ABSTRACT

A tufting machine having a needle bar moveable transversely to the direction of movement of the base material has a stitch placement drive including a stepper cam and a cam drive adapted selectively to rotate the cam through a predetermined angle and in a predetermined direction. A sensor operative in response to the position of the needles energizes the cam drive when the needles are in a retracted position. The cam drive includes a motor, and gearing provided between the motor and the cam so that one revolution of the gearing causes rotation of the cam through an angle substantially equal to the angular separation of the steps about the periphery of the cam. The motor is braked when it is in a datum position as determined by a second sensor coupled to the motor, the brake and an indexing pattern device which controls the rotational direction and number of revolutions made by the motor.

20 Claims, 3 Drawing Figures

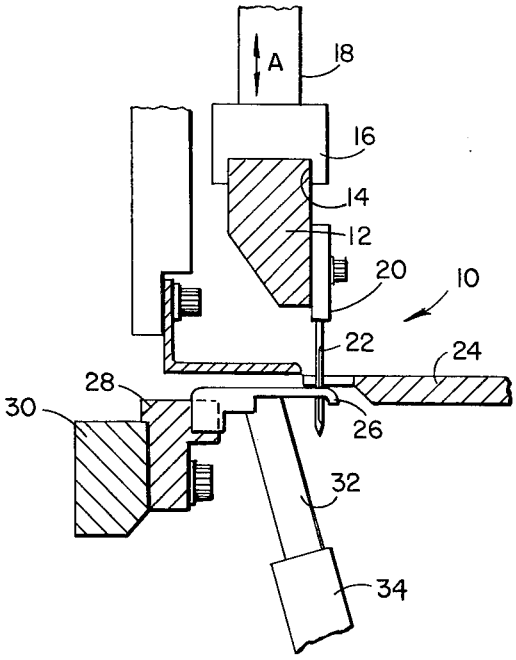
FIG. 1
FIG. 2
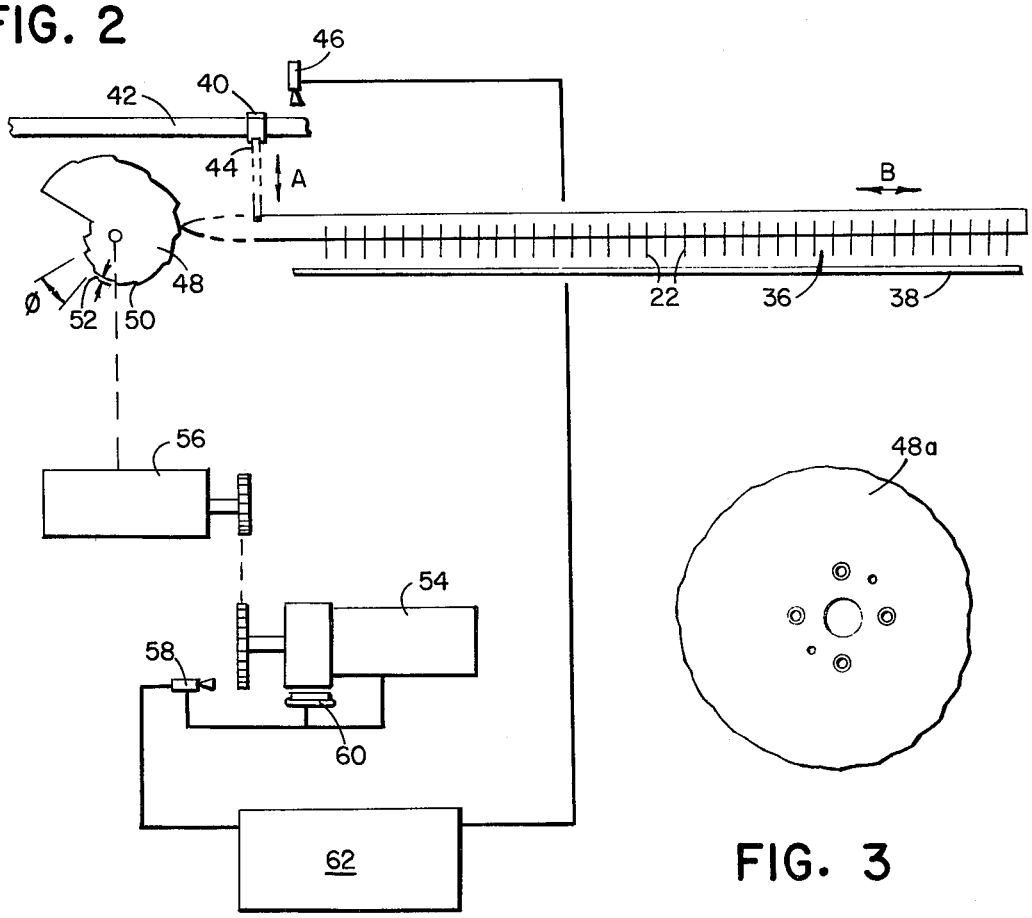
FIG. 3

TUFTING MACHINE APPARATUS

BACKGROUND OF THE INVENTION

This invention relates to tufting machines, and more particularly to means for moving the needle bar of a tufting machine longitudinally of itself so as to provide a patterning effect in the tufted fabric being produced.

Such patterning means, generally referred to as needle shifting or stitch placement drives, conventionally fall into two categories. The first category is that of the cam driven type whereby a rotating plate cam, driven directly from the machine mainshaft, is drivingly engaged with the needle bar so as to effect the required displacement thereof. The second category is that of the progammable type which may be hydraulically or pneumatically driven, or driven mechanically through some form of programmable indexing device whereby a ram is drivingly engaged with the needle bar so as to effect the required displacement thereof. Examples of such drives are illustrated in U.S. Pat. Nos. 4,173,192 and 4,010,700, and U.S. application Ser. No. 245,377 filed Mar. 19, 1981.

The cam driven type has the advantage of being simple, inexpensive and reliable. With this type breakdowns are infrequent and repair is easily and speedily effected when required. However, in order to produce tufted fabrics of differing patterns it is necessary to provide differing cams and to change cams when a pattern change is required. Consequently, it is impractical to conduct sampling trials for differing new designs since an appropriate cam is required for each pattern variation being considered.

The hydraulically, pneumatically and mechanically indexed types are more complex and costly than the cam driven types and are more prone to breakage and malfunctions. Maintenance and repair is complex and time consuming and for these reasons many carpet manufacturers prefer to use cam driven machines. However, the programmable types have the advantage that their programs may be readily changed so as to provide differing patterns of tufted fabric. As a consequence if a carpet manufacturer wishes to conduct sampling trials with differing new designs he must either purchase a machine having such a programmable needle bar traverse mechanism or buy time on such a machine belonging to another carpet manufacturer or tufting machine manufacturer.

SUMMARY OF THE INVENTION

Consequently, it is a primary object of the present invention to provide a tufting machine needle bar traversing drive mechanism, or stitch placement drive, having the simplicity and reliability of the cam driven type but which may be readily programmed to produce differing patterns of tufted fabric for trial sampling purposes.

It is another object of the present invention to provide programmable means that may be readily installed in a tufting machine having a cam driven traversely shiftable needle bar for producing different tufted patterns for trial sampling.

It is a further object of the present invention to provide in a tufting machine having a conventional cam driven transversely shiftable needle bar, apparatus for indexing the cam in a preselected direction and through a preselected angle so that the needle bar may be shifted in a predetermined direction through a predetermined number of steps or needle pitch increments.

It is a still further object of the present invention to provide in a tufting machine having a needle bar mounted for slidable transverse movement relative to the direction of reciprocation of the needles, and a cam rotatably driven by a gear box for shifting the needle bar transversely, a braked gear motor for driving the gear box and programmable indexing means for controlling the direction and the number of revolutions made by the gear motor so as to rotate the cam in either direction a predetermined number of revolutions for shifting the needle bar in accordance with a pattern determined by the indexing means.

Accordingly, the present invention provides in a tufting machine having a needle bar moveable in a direction longitudinally of itself transverse to the direction of movement of the base material, and a stitch placement drive including a cam for effecting such needle bar movement, a cam drive means selectively energized in accordance with a pattern for rotatably driving the cam through a predetermined angle and in a requisite direction when the needles are in a retracted position relative to the base material being fed through the machine, the cam having around its periphery a plurality of steps adapted to provide the movement of the needle bar in increments through a range of movement determined by the cam. The cam may be a snail cam or a step cam having a continuous periphery.

Preferably the height of each step provided on the periphery of the cam corresponds with a movement of the needle bar equal to the pitch of the needles on the needle bar, in which case the increments correspond with the pitch of the needles and the number of steps is equal to the number of pitches in the predetermined range of needle bar movement. Alternatively the height of a or any step corresponds with a multiple of the pitch of the needles, the multiple being an integer.

It is to be understood that the predetermined angle of rotary movement of the cam is equal to the angular separation of the steps around the periphery or a multiple of such angular separation such that rotation of the cam through the predetermined angle moves the needles through the predetermined number of steps or number of pitches in the predetermined range of needle bar movement.

The cam drive means may comprise a motor and gearing provided between the motor and the cam whereby one revolution of the gearing causes rotation of the cam through an angle substantially equal to the angular separation of the steps thereon. The motor may be a braked gear motor.

A first sensing means operative in response to the reciprocatory position of the needle bar may energize the cam drive means when the needles are in a retracted position relative to the base material fed through the machine. A second sensing means may be provided for sensing a datum position of rotation of the motor and to activate the brake when the motor is in the datum position.

An indexing pattern device may be provided and coupled with the second sensing means, the indexing pattern device being adapted to control the successive rotations of the motor to be a predetermined number of revolutions in a forward or reverse direction. The indexing pattern device may be connected with the first sensing means to sequence the operation of the motor with the reciprocation of the needle bar. Preferably the indexing pattern device comprises a punched tape operated device, whereby a change of pattern produced by the machine may be effected by a change of the punched tape fed to the indexing pattern device.

BRIEF DESCRIPTION OF THE DRAWINGS

The particular features and advantages of the invention as well as other objects will become apparent from the following description taken in connection with the accompanying drawings, in which:

FIG. 1 is a diagrammatic side sectional elevational view of a part of a tufting machine having a shiftable needle bar;

FIG. 2 is a diagrammatic general arrangement of the tufting machine illustrated in FIG. 1 incorporating one embodiment in accordance with the principles of the present invention; and FIG. 3 is a diagrammatic view of another cam adapted for use with the invention.

DESCRIPTION OF THE PREFERRED EMBODIMENT

Referring now to the drawings, and in particular to FIG. 1, the relevant portions of a tufting machine 10 are illustrated as including a needle bar 12 slidably supported within a slideway 14 of needle bar carrier 16 supported at the end of a plurality of push rods 18 (only one of which is illustrated). Secured to the needle bar 12 are needle module units 20 each carrying a plurality of needles 22. Mounted in the bed of the tufting machine beneath a bed plate 24 is a plurality of loopers or hooks 26 which may also be mounted in modular form carried by a body member 28 secured to a hook bar 30. The needle bar 12 may be oscillated in conventional manner in timed relationship with the reciprocation of the needles 22 so that each looper 26 cooperates with a respective needle 22 to seize loops presented thereby. The hooks 26 may also cooperate with respective knives 32 carried by a knife block 34 and oscillated in timed relationship with the oscillation of the hooks for cutting loops of yarn on the hooks to form cut pile.

The needles 22 are spaced apart along the length of the needle bar 12 at a pitch denoted by the arrow 36. The needle bar 12 is moveable toward and away from a backing material 38 being fed through the machine over the bed plate 24 in a direction normal to the reciprocation of the needles, the direction of reciprocation being illustrated by the arrow A, and in the configuration shown in FIG. 2 the needles 22 are in the retracted position relative to the backing material 38. Reciprocation of the needle bar 12 is provided by conventional means which may include an eccentric cam 40 mounted on a rotary mainshaft 42 to drive an eccentric strap 44 to reciprocate the push rods 18. As with any shiftable needle bar tufting machine a sensing device 46 senses the rotational position of the mainshaft 42 of the machine so as to be responsive to the cyclical position of the needles 22.

The needle bar 12 is also moveable longitudinally of itself as shown by the arrow B transverse to the direction of movement of the backing material and such movement is effected by means of a snail cam 48, i.e., a cam having a peripheral configuration that gradually grows in steps and then drops sharply from the last step at the maximum radius to the first step at the minimum radius, or a conventional stepping cam 48*a* having steps that rise and fall along a continuous periphery. The cam 48 is provided with a plurality of steps 50 of height 52 equal to the pitch 36 of the needles 22 in the case of a direct drive between the cam 48 and the needle bar 12, or such as will also provide movement of the needle bar 12 equal to the pitch 36 in the case of an indirect drive between the cam 48 and the needle bar 12 having a gearing ratio other than 1:1. For clarity only twelve (12) steps 50 are shown on cam 48 whereas in practice forty (40) or more steps 50 may be provided. Similarly the steps of the cam 48*a* will be of a height to provide movement of the needle bar equal to the pitch 36, and if rotated through 360 degrees may drive the needle bar through a range in one direction and then reverse the direction back to the initial position.

Either of the cams 48, 48*a* may be rotatably driven by means of a braked gear motor 54, a worm box 56 being provided therebetween so that one revolution of the output of the gear motor 54 produces rotation of the cam 48 through an angle $\phi$ equal to the angular separation of the steps 50. It is noted that the worm box 56 conventionally drives the cam of a conventional shiftable needle bar. A sensing means 58 is provided adjacent the motor 54 to sense the datum position thereof and is coupled with the braking means 60 of motor 54 so as to brake the motor 54 in the datum position.

A punched tape operated indexing pattern device 62 is coupled with the sensing means 58 and provides that each successive rotation of gear motor 54 is a predetermined number of revolutions in the forward or reverse direction. The device 62 is also coupled to the mainshaft sensing means 46 so that operation of the gear motor 18 can only occur when the needles 22 are in the retracted position relative to the backing material 38.

Ordinarily the machine 10 will be operated in stepwise manner, any necessary indexing of the cam 48 or the cam 48*a* and longitudinal placement of the needle bar 12 being effected between successive machine cycles. In this case operation of the geared motor drive 54 occurs in response to the completion of a machine cycle as sensed by mainshaft sensor 48, and the next machine cycle is initiated only on completion of the cam indexing actuation of motor 54 as sensed by sensor 58. This procedure avoids the risk of reciprocation of needles 32 except in the circumstances of proper alignment thereof with the cooperating other gauge parts, e.g. loopers 26, of machine 10. It may be acceptable in some circumstances to effect the indexing of cam 48 and longitudinal placement of needle bar 12 while maintaining continuous operation of machine 10 at a speed such that the gear motor 54 can complete the cam indexing and needle bar placement during the time that the needles 22 are retracted. However, such operation of the machine 10 carries the risk of improper alignment of needles 22 and cooperating gauge parts at the time of penetration.

The device of the invention operates as follows. On each occasion that the needle bar 12 is moved to the retracted position as sensed by mainshaft sensor 46, a signal is given to index pattern device 62 which in turn gives a signal to sensing means 58 dependent upon the information on the tape within the pattern device 62.

The tape carries information representing the desired successive longitudinal movements of the needle bar, which may be any number of pitches 36 to left or right, or no movement at all. Dependent upon the signal received by the sensing means 58 from the pattern device 62 the brake 60 is released, the motor 54 effects the required number of revolutions and then is braked to rest when the sensing means 58 again senses that the motor 54 is in the datum position. Rotation of motor 54 causes cam 48 to rotate through a number of angular displacements $\phi$ equal to or proportional to the number of revolutions of motor 54 and in turn the needle bar 12 is moved through an equal number of pitches 36. Thus, one revolution of the motor effects one pitch movement of the cam and one pitch movement of the needles. As previously mentioned during such movement of motor 54, cam 48 (or cam 48*a*) and the needle bar 12, the needle bar 12 may remain in the retracted position with the advance/retraction drive thereto interrupted. During the next advance and retraction of the needles 22 to and from the backing material 38 the pattern device 62 indexes the tape therein so as to read the next information thereon.

In order to change the pattern of the machine 10 it is only necessary to change the tape in the pattern device 62. Consequently, the machine of the invention combines the simplicity, low cost and reliability of the conventional cam driven machines with the versatility of the programmable driven machines.

Alternative embodiments of machine in accordance with the invention will be readily apparent to persons skilled in the art. For example, a magnetic tape may be used instead of the punched tape described herein. As another alternative gearing other than a worm box may be provided between the motor 54 and the cam 48. Also the sensing means 46 may sense the position of the needle bar 12 directly instead of sensing the position of the mainshaft 42 of the machine.

However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a reciprocable needle bar carrying a multiplicity of needles for penetrating a base material being fed through the machine and having means for mounting the needle bar for movement transverse to the direction the base material is fed, drive means for moving the needle bar transversely selectively to alter the location of the penetration of the base material by the needles, said drive means comprising, a peripheral cam having a plurality of discreet steps thereabout, means for operatively connecting said cam to said needle bar for drivingly moving said needle bar transversely in increments throughout a range of movements determined by said cam, cam drive means adapted selectively to drive said cam rotatably through a predetermined angle and in a selected direction, and first sensing means responsive to the cyclical position of the needles for energizing said cam drive means when said needles are in a retracted position relative to the base material.

2. In a tufting machine as recited in claim 1, wherein the height of each step on said cam relative to the adjacent steps is substantially equal to a multiple of the spacing between adjacent needles, and said multiple being an integer.

3. In a tufting machine as recited in claim 1, wherein said predetermined angle is substantially equal to a multiple of the angular separation between adjacent steps of said cam, and said multiple is an integer.

4. In a tufting machine as recited in claim 1, wherein said cam drive comprises rotatable motor means selectively rotated through a selective number of revolutions in either direction, gear means intermediate said cam and said motor means driven by said motor means, and means connecting said gear means to said cam for rotating said cam through said predetermined angle upon each revolution of said gearing.

5. In a tufting machine as recited in claim 1, wherein said cam drive comprises motor means rotatable through a selective number of revolutions in either direction, brake means adapted to stop the rotation of said motor means at a datum position after the motor means has been rotated through the selected number of revolutions.

6. In a tufting machine as recited in claim 5, including a second sensing means for sensing the datum position of rotation of said motor means for activating said brake to stop the rotation of said motor means at the datum position.

7. In a tufting machine as recited in claim 6, including an indexing means providing a control signal for controlling the successive rotations of said motor means and the direction thereof, said indexing means being operatively connected to said second sensing means, said brake means and said motor means to synchronize the stopping of the motor means at the datum position after the motor means has rotated through the selected number of revolutions.

8. In a tufting machine as recited in claim 7, wherein said indexing means provides said control signal in response to a pattern.

9. In a tufting machine as recited in claim 8, wherein said indexing means reads the pattern from a punched tape.

10. In a tufting machine as recited in claim 2, wherein said cam is a snail cam.

11. In a tufting machine as recited in claim 1, wherein the rotation of said cam stops upon attaining said predetermined angle.

12. In a tufting machine as recited in claim 7, wherein the height of each step on said cam relative to the adjacent steps is substantially equal to a multiple of the spacing between adjacent needles, and said multiple being an integer.

13. In a tufting machine as recited in claim 12, wherein said predetermined angle is substantially equal to a multiple of the angular separation between adjacent steps of said cam, and said multiple is an integer.

14. In a tufting machine as recited in claim 13, wherein said indexing means provides said control signal in response to a pattern.

15. In a tufting machine as recited in claim 14, wherein said indexing means reads the pattern from a punched tape.

16. In a tufting machine having a reciprocable needle bar carrying a multiplicity of needles for penetrating a base material being fed through the machine and having means for mounting the needle bar for movement transverse to the direction the base material is fed, drive means for moving the needle bar transversely selectively to alter the location of the penetration of the base material by the needles, said drive means comprising, a peripheral cam having a plurality of discreet steps thereabout, means for operatively connecting said cam to said needle bar for drivingly moving said needle bar transversely in increments throughout a range of movements determined by said cam, cam drive means for rotatably driving said cam, and first sensing means responsive to the cyclical position of the needles for energizing said cam drive means when said needles are in a retracted position relative to the base material, the improvement comprising intermittent drive means for driving said cam through a predetermined angle and in a selected direction.

17. In a tufting machine as recited in claim 16, wherein said intermittent drive means comprises motor means rotatable through a selective number of revolutions in either direction, brake means adapted to stop the rotation of said motor means at a datum position after the motor means has been rotated through the selected number of revolutions.

18. In a tufting machine as recited in claim 17, including a second sensing means for sensing the datum position of rotation of said motor means for activating said brake to stop the rotation of said motor means at the datum position.

19. In a tufting machine as recited in claim 18, including an indexing means providing a control signal for controlling the successive rotations of said motor means and the direction thereof,said indexing means being operatively connected to said second sensing means, said brake means and said motor means to synchronize the stopping of the motor means at the datum position after the motor means has rotated through the selected number of revolutions.

20. In a tufting machine as recited in claim 19, wherein said indexing means provides said control signal in response to a pattern.

* * * * *